US008973625B2

(12) United States Patent
Liao

(10) Patent No.: US 8,973,625 B2
(45) Date of Patent: Mar. 10, 2015

(54) STRUCTURE OF OIL FILLING DEVICE

(71) Applicant: Lih Yann Industrial Co., Ltd., Taichung, Taiwan (TW)

(72) Inventor: Po Lin Liao, Taichung (TW)

(73) Assignee: Lih Yann Industrial Co., Ltd., Taichung (TW)

( * ) Notice: Subject to any disclaimer, the term of this patent is extended or adjusted under 35 U.S.C. 154(b) by 282 days.

(21) Appl. No.: 13/739,103

(22) Filed: Jan. 11, 2013

(65) Prior Publication Data

US 2014/0196816 A1 Jul. 17, 2014

(51) Int. Cl.
*B65B 39/02* (2006.01)

(52) U.S. Cl.
CPC ..... *B65B 39/02* (2013.01)
USPC ..... 141/332; 141/333; 141/340; 141/371

(58) Field of Classification Search
USPC ..... 141/331 R, 331–334, 370–371
See application file for complete search history.

(56) References Cited

U.S. PATENT DOCUMENTS

| | | | | |
|---|---|---|---|---|
| 3,939,884 | A * | 2/1976 | Mader | 141/333 |
| 4,600,125 | A * | 7/1986 | Maynard, Jr. | 222/81 |
| 5,033,521 | A * | 7/1991 | Martin | 141/337 |
| 5,188,157 | A * | 2/1993 | Lee | 141/338 |
| 5,228,488 | A * | 7/1993 | Fletcher | 141/331 |
| 6,340,038 | B1 * | 1/2002 | Ingram | 141/333 |
| 6,450,219 | B1 * | 9/2002 | Ingram | 141/333 |
| 6,568,440 | B1 * | 5/2003 | Engelbrecht | 141/338 |
| 7,527,174 | B2 * | 5/2009 | Meehan et al. | 222/180 |
| 2012/0267006 | A1 * | 10/2012 | Liao | 141/331 |

* cited by examiner

*Primary Examiner* — Nicolas A Arnett
(74) *Attorney, Agent, or Firm* — Andrew C. Cheng

(57) ABSTRACT

An oil filling device includes an oil filling funnel, an extendable tube assembly, a direction adjustment assembly, and a coupling assembly. The oil filling funnel is mounted to a first end of the extendable tube assembly. The extendable tube assembly has a second end mounted to the direction adjustment assembly. The direction adjustment assembly is mounted to the coupling assembly that is attachable to an oil filling hole of an engine. The direction adjustment assembly enables adjustment of the direction of the extendable tube assembly and the oil filling funnel with respect to the engine, while the extendable tube assembly allows the oil filling funnel to be selectively moved toward or away from the oil filling hole. Thus, the oil filling device may accommodate various heights and angles of oil filling hole of engine and allows filling of oil into the engine to be conducted in a smoother manner.

2 Claims, 8 Drawing Sheets

STRUCTURE OF OIL FILLING DEVICE

BACKGROUND OF THE INVENTION

1. Field of the Invention

The present invention relates to an oil filling device, and in particular to an oil filling device that enables adjustment of relative direction and distance between an oil filling funnel of the device and an engine oil filling hole so as to allow the oil filling device to accommodate various models and types of engine.

2. The Related Arts

Vehicles, such as automobiles and motorcycles, comprise an engine that is provided with an oil pan having a small filling opening. It is often that over-filling of oil result in spillage or overflowing of the oil outside the engine, causing environmental pollution when falling to the ground. In addition, when a large amount of oil is filled into an oil tube in a short period, air bubbles are generated and stuck in the oil tube so that the air may not be discharged and thus block oil from being further filled. This affects the efficiency and smoothness of the operation of filling oil and may often lead to spillage of oil due to negligence.

Further, the location and direction of the oil filling opening are different from each other for different engines. Heretofore, oil filling devices are generally not adjustable and are thus not fit to the oil filling openings of various models and types of vehicles. Consequently, it is common to change the oil filling devices when it is attempted to fill oil to different models or types of vehicles. This is certainly very troublesome. Apparently, the conventional, non-adjustable oil filling devices can be further improved.

Thus, it is desired to provide an oil filling device that overcomes the above discussed problems.

SUMMARY OF THE INVENTION

An object of the present invention is to provides an oil filling device, which enables adjustment of direction of an oil filling funnel with respect to an oil filling hole of an engine and also enables adjustment of distance between the oil filling funnel and the engine oil filling hole, whereby the oil filling device is applicable to filling oil to various models and types of engines.

To achieve the above object, the present invention provides an oil filling device, which comprises an oil filling funnel, an extendable tube assembly, a direction adjustment assembly, and a coupling assembly. The oil filling funnel is mounted to a first end of the extendable tube assembly. The extendable tube assembly has a second end mounted to the direction adjustment assembly. The direction adjustment assembly is mounted to the coupling assembly that is attachable to an oil filling hole of an engine. The direction adjustment assembly enables adjustment of the direction of the extendable tube assembly and the oil filling funnel with respect to the engine, while the extendable tube assembly allows the oil filling funnel to be selectively moved toward or away from the oil filling hole. Thus, the oil filling device may accommodate various heights and angles of engine oil filling hole and allows filling of oil into the engine to be conducted in a smoother manner.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
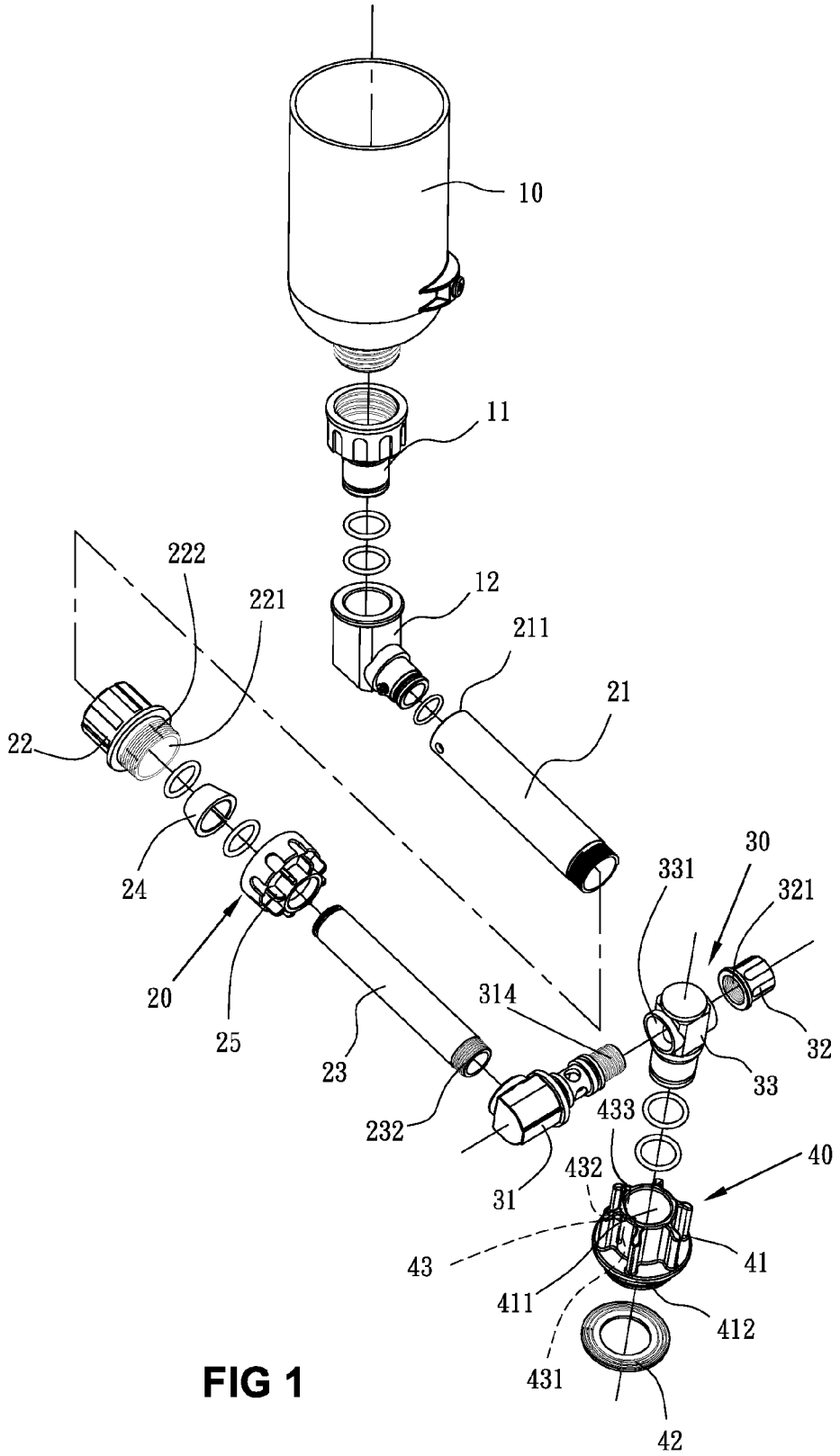
FIG. 1 is an exploded view showing an oil filling device according to the embodiment of the present invention.
Figure 2:
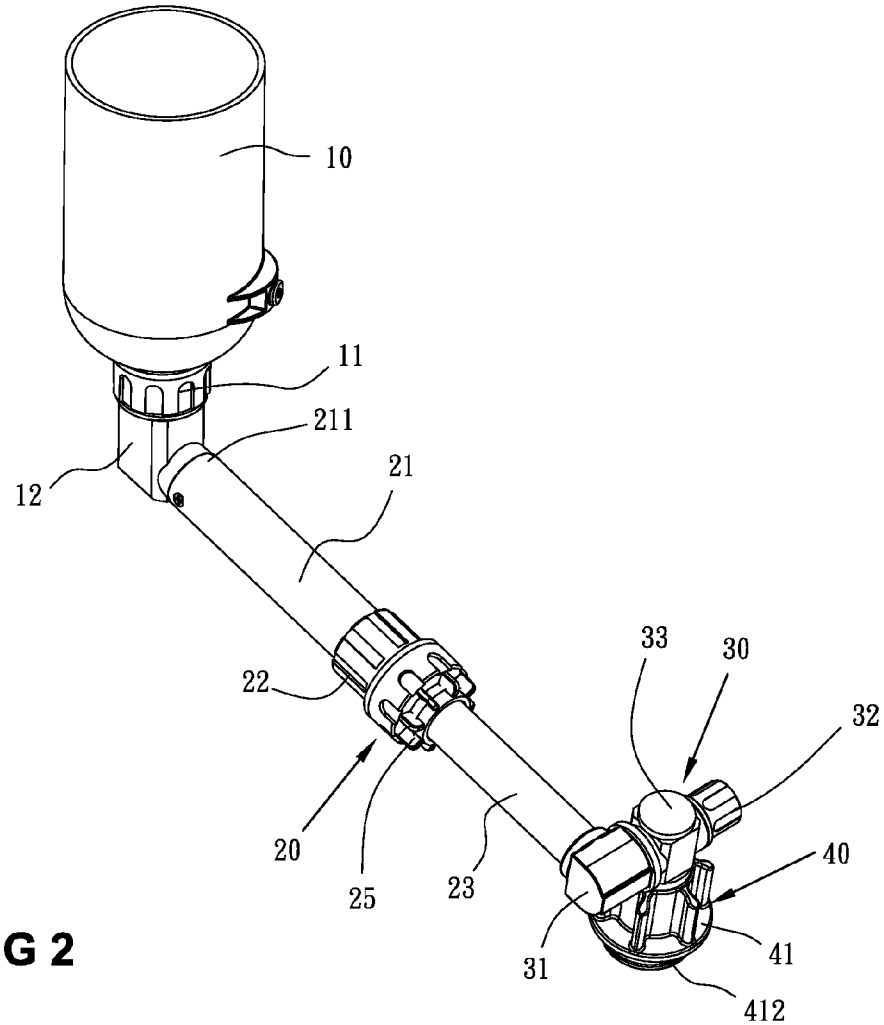
FIG. 2 is a perspective view, in an assembled form, of the oil filling device according to the present invention.

With reference to the drawings and in particular to FIGS. 1 and 2, the present invention provides an oil filling device, which comprises a oil filling funnel 10, which has a lower end connected to an insertion connector 11. The insertion connector 11 has a lower end connected to an angled fitting 12.

An extendable tube assembly 20 comprises a first tubular member 21 that has a first end 211. The angled fitting 12 has a free end that is fit into the first end 211 of the first tubular member 21 of the extendable tube assembly 20. The first tubular member 21 has a free end to which an end connector 22 is mounted. The end connector 22 comprises a tapered bore 221 formed therein and the tapered bore 221 receives a second tubular member 23 to telescopically extend therethrough. The tapered bore 221 comprises a tapered section that receives and retains therein a conical wedge block 24 having a C-shaped cross-section. A fastening element 25, which is internally threaded, is mounted to an external thread 222. After the second tubular member 23 is telescopically received and sets a desired length, the fastening element 25 is rotated to urge the conical wedge block 24 further into the tapered bore 221 so as to get compressed and securely fix the first tubular member 21 and the second tubular member 23 to each other to thereby achieve the functions of extension for adjustment and also fixing at selected length.

A direction adjustment assembly 30 comprises a rotary adjustment knob 31, a fastening knob 32, and a T-shaped fitting 33. The T-shaped fitting 33 has a top portion through which a lateral passage 331 is formed to receive the rotary adjustment knob 31 to extend therethrough in such a way as to maintain the rotary adjustment knob 31 rotatable. The rotary adjustment knob 31 has an end that receives, engages, and fixes an external thread 232 formed on a free end of the second tubular member 23. The rotary adjustment knob 31 has an opposite free end forming an external thread 314 with which an internal thread 321 formed in the fastening knob 32 engages, whereby when the rotary adjustment knob 31 is rotated to a desired angular position, the fastening knob 32 is rotated to tightly abut the T-shaped fitting 33 so as to secure the position of the rotary adjustment knob 31.

A coupling assembly 40 comprises a locking cap 41, in which an axially extending insertion bore 411 is formed. The insertion bore 411 receives the T-shaped fitting 33 to inset therein. In operation, the insertion bore 411 is set in communication with an interior of an engine 50 (see FIG. 8). The locking cap 41 as a lower end forming an external thread 412 that is engageable with an internal thread 511 of an oil filling opening 51 of the engine 50 (see FIG. 8). The external thread 412 can be further provided with a gasket ring 42 set around an outer circumference of the external thread. The locking cap 41 has a side portion in which an inverted T-shaped vent hole 43 is formed, whereby a first opening 431 of the inverted T-shaped vent hole 43 is in communication with the interior of the engine 50, a second opening 432 is formed in a side surface of the locking cap 41 to communicate with the outside atmosphere, and a third opening 433 is formed in a top of the locking cap 41 to communicate with the outside atmosphere so as to enable an oil filling operation to be done in a smoother manner without jamming.

Figure 3:
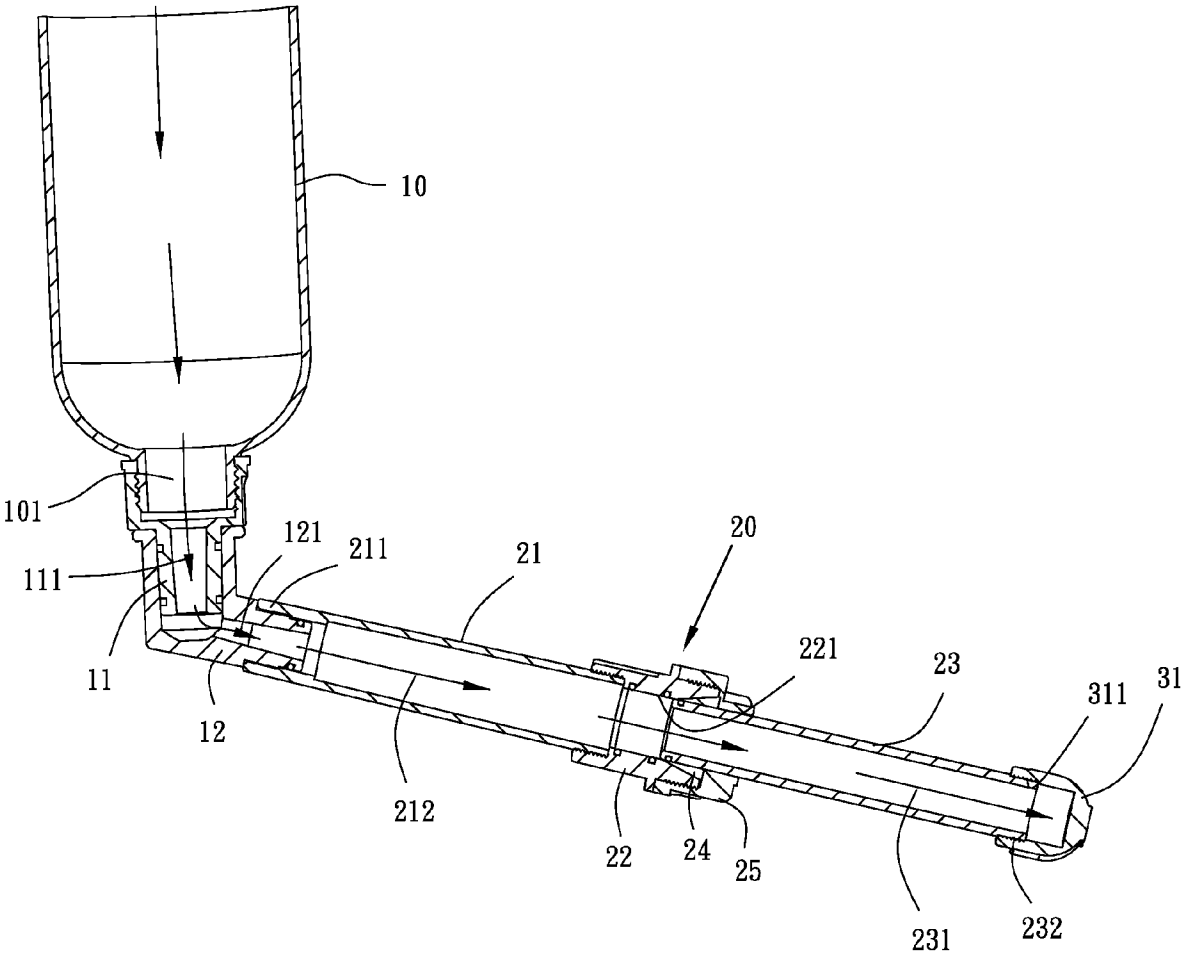
FIG. 3 is a cross-sectional view of a portion of the oil filling device of the present invention, particularly showing details of an extendable tube assembly of the oil filling device.
Figure 4:
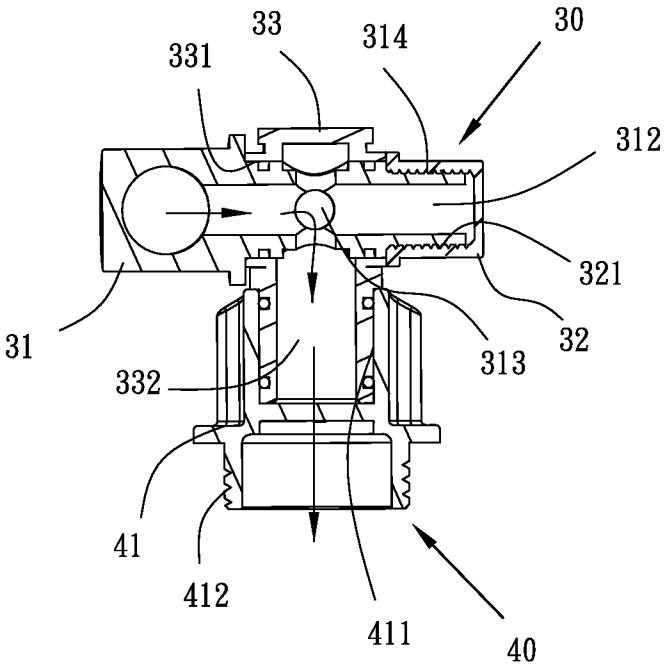
FIG. 4 is a cross-sectional view of a portion of the oil filling device of the present invention, particularly showing a direction adjustment assembly to which a coupling assembly is attached.

Referring to FIGS. 3 and 4, as discussed above, the oil filling device according to the present invention comprises an oil filling funnel 10 having a lower end to connect to an insertion connector 11 and the insertion connector 11 has a lower end connected to the angled fitting 12, whereby a funnel hole 101, a connector hole 111, and an angled fitting hole 121 are in communication with each other. The angled fitting 12 has a free end that is fit to the first end 211 of the first tubular member 21 of the extendable tube assembly 20 in such a way that the angled fitting hole 121 is in communication with a first bore 212 of the first tubular member 21. The first tubular member 21 has a free end to which an end connector 22 is mounted.

The end connector 22 comprises an internal tapered bore 221, which telescopically receives the second tubular member 23 to extend therethrough. The tapered bore 221 comprises a tapering section that receives and retains the conical wedge block 24 therein. The fastening element 25 comprises an internally threaded hole 251 and the end connector 22 has an outer circumference that forms an external thread 222 engaging the internally threaded hole 251 of the fastening element 25.

Once the second tubular member 23 is extended or retracted to a desired length, the fastening element 25 is rotated to drive the conical wedge block 24 further into the tapered bore 221 so as to compress the wedge block and thus fix the first tubular member 21 and the second tubular member 23 to each other to achieve the functions of extension for adjustment and also fixing at selected length.

The first bore 212 of the first tubular member 21 is in communication with a second bore 231 of the second tubular member 23.

The direction adjustment assembly 30 that comprises the rotary adjustment knob 31, the fastening knob 32, and the T-shaped fitting 33 is structured so that the T-shaped fitting 33 has a top portion forming the lateral passage 331 to receive the rotary adjustment knob 31 to extend therethrough. The T-shaped fitting 33 also has a lower portion forming a vertical passage 332 extending from and in communication with the lateral passage 331. The rotary adjustment knob 31 is rotatable and has an end (leading end) forming an internally-threaded hole 311 that engages an external thread 232 formed at a free end of the second tubular member 23.

The rotary adjustment knob 31 has an opposite end (tailing end) forming a hole 312 in communication with the internally-threaded hole 311. The rotary adjustment knob 31 has a circumferential wall in which a plurality of through holes 313 is formed to correspond to the vertical passage 332 to communicate with the vertical passage 332. The rotary adjustment knob 31 comprises an external thread 314 formed at the tailing end to engage an internal thread 321 formed in the fastening knob 32, whereby when the rotary adjustment knob 31 is set at a desired angular position, the fastening knob 32 is rotated to abut against the T-shaped fitting 33 and thus secure the rotary adjustment knob 31 in position.

The coupling assembly 40 comprises the locking cap 41, which forms an axially extending insertion bore 411 to receive and retain the T-shaped fitting 33 in such a way that the vertical passage 332 is in communication with the insertion bore 411. The insertion bore 411 is set in communication with the engine 50 (see FIG. 8). The locking cap 41 has a lower end forming an external thread 412 engageable with the internal thread 511 of the oil filling opening 51 of the engine 50 (see FIG. 8).

Oil is filled through the funnel hole 101 of the oil filling funnel 10, passing through the connector hole 111, the angled fitting hole 121, the first bore 212, the tapered bore 221, the second bore 231, the internally-threaded hole 311, the hole 312, the through holes 313, the vertical passage 332, and the insertion bore 411 to get into the interior of the engine 50.

Figure 5:
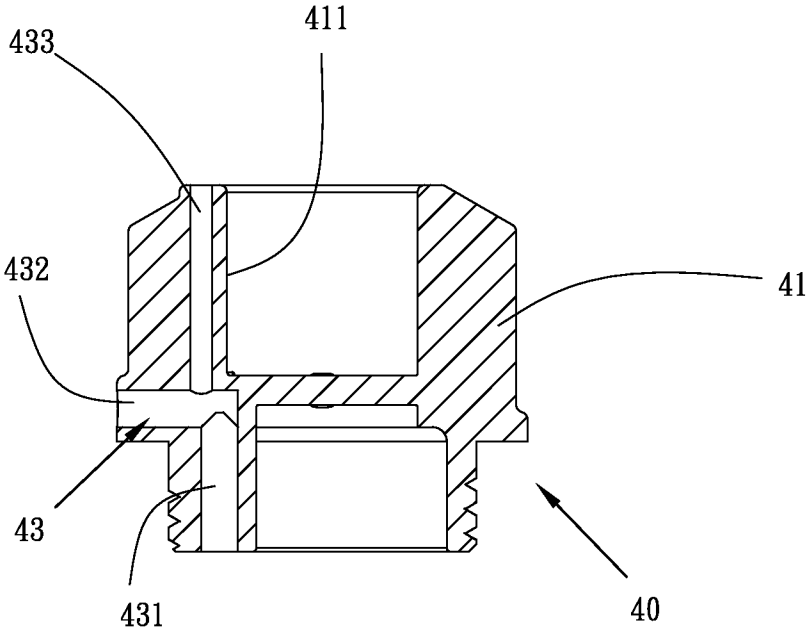
FIG. 5 is a cross-sectional view showing a locking cap of the coupling assembly of the oil filling device according to the present invention.

Referring to FIG. 5, the locking cap 41 has a side portion forming the inverted T-shaped vent hole 43, whereby the first opening 431 of the inverted T-shaped vent hole 43 is in communication with the engine 50, the second opening 432 is formed in a side surface of the locking cap 41 to communicate with the outside atmosphere, and the third opening 433 is formed in the top of the locking cap 41 to communicate with the outside atmosphere so as to enable an oil filling operation to be done in a smoother manner without jamming.

Figure 6:
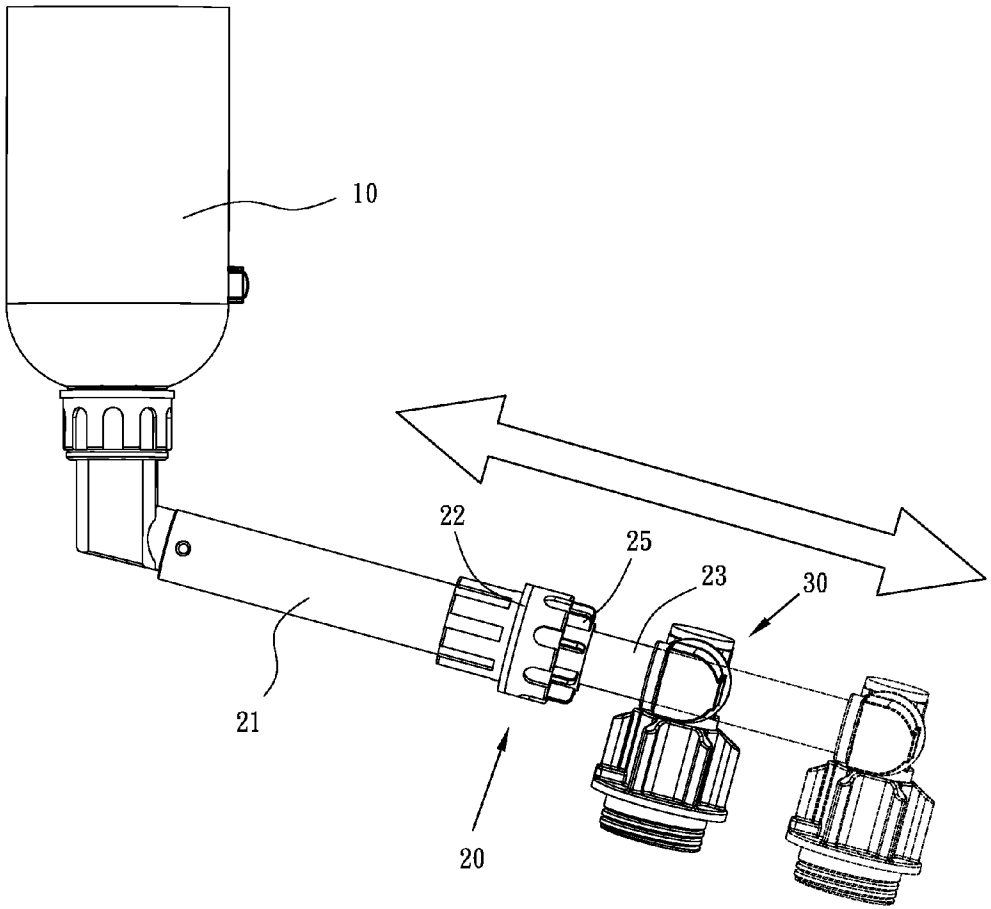
FIG. 6 is a side elevational view illustrating an extension operation of the oil filling device according to the present invention.

Referring to FIG. 6, the extendable tube assembly 20 has two opposite ends that are respectively connected to the oil filling funnel 10 and the direction adjustment assembly 30. The second tubular member 23 of the extendable tube assembly 20 is telescopically received through the end connector 22 and the first tubular member 21, whereby after being set to a desired length, the fastening element 25 is rotated to fix the first tubular member 21 and the second tubular member 23 to each other achieve the functions of extension for adjustment and also fixing at selected length.

Figure 7:
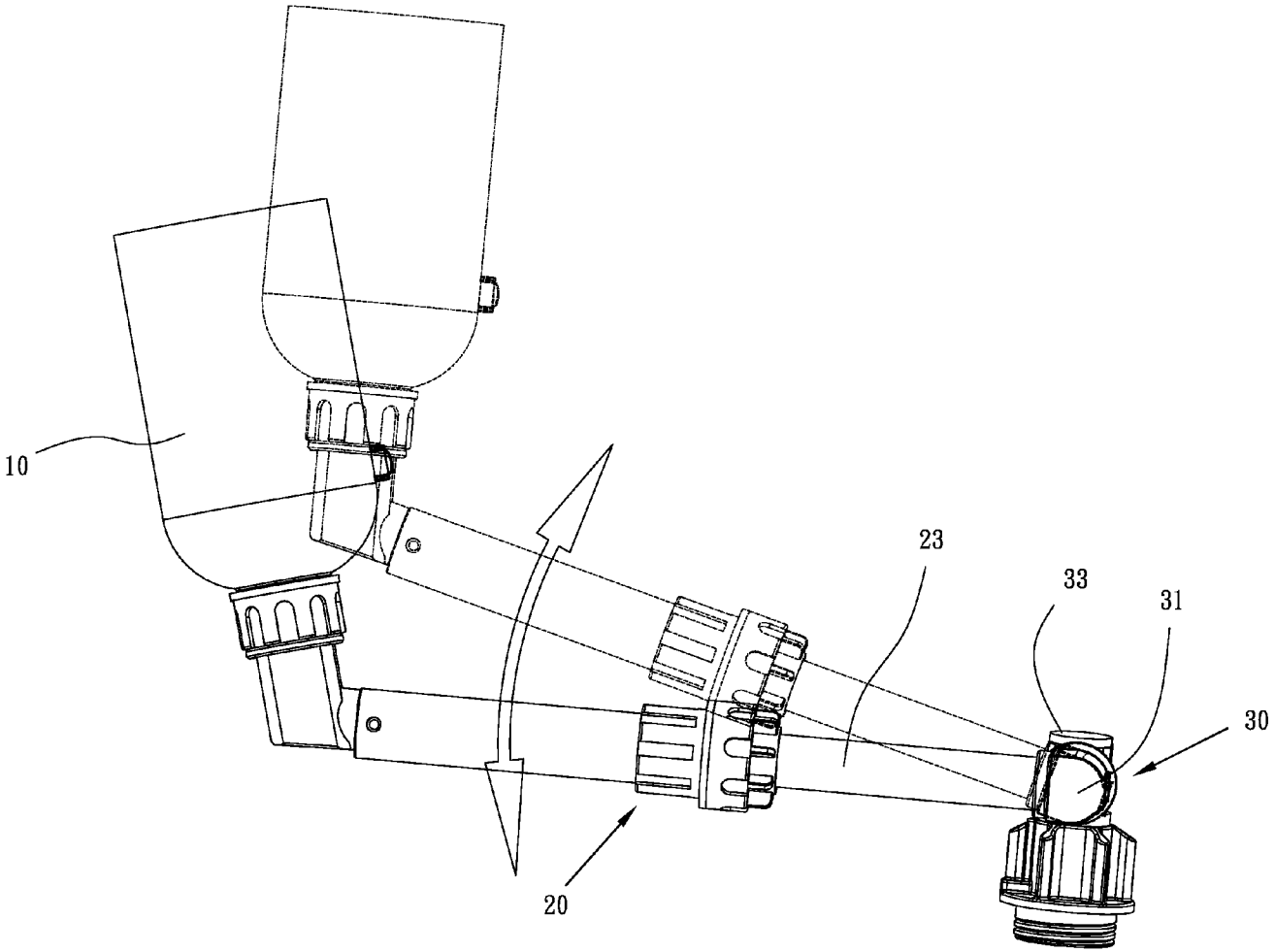
FIG. 7 is a side elevational view illustrating a direction adjustment operation of the oil filling device according to the present invention.

Referring to FIGS. 1 and 7, according to the present invention, the rotary adjustment knob 31 of the direction adjustment assembly 30 is kept in a selectively rotatable condition and the leading end of manner of the rotary adjustment knob 31 is coupled to the second tubular member 23 through mating engagement with the external thread 232 of the second tubular member. Further, the rotary adjustment knob 31 comprises an external thread 314 formed at the tailing end thereof to mate the internal thread 321 of the fastening knob 32, whereby when the rotary adjustment knob 31 is rotated to a desired angular position, generally with respect to the T-shaped fitting 33 and the coupling assembly 40, the fastening knob 32 can be fastened to abut the T-shaped fitting 33 and thus secure the rotary adjustment knob 31 in position.

Figure 8:
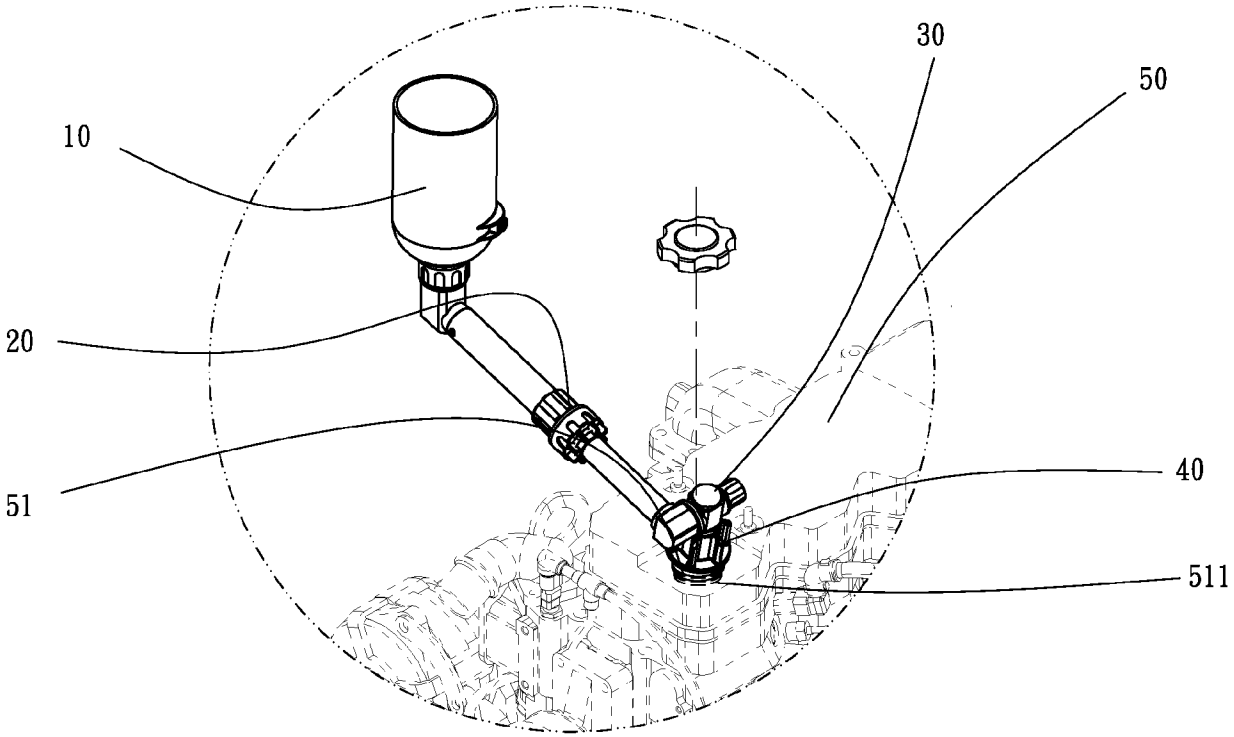
FIG. 8 is a perspective view illustrating an application of the oil filling device according to the present invention to filling oil into an engine.

Referring to FIGS. 1 and 8, the coupling assembly 40 is provided for coupling to the oil filling opening 51 of an engine 50 and the relative angle (or direction) between the direction adjustment assembly 30 with respect to the coupling assembly 40 can be adjusted as desired to set the direction the extendable tube assembly 20 and the oil filling funnel 10 with respect to the coupling assembly and the engine. The extendable tube assembly 20 can be adjusted to set the relative distance between the oil filling funnel 10 and the oil filling opening 51 of the engine 50 to selectively make them approaching to each other or distant from each other. In this way, the oil filling device can accommodate various heights and angles of oil filling opening 51 to allow the filling of oil into an engine to be done more smoothly.

It is apparent that the oil filling device according to the present invention enables adjustment of position and direction thereof with respect to an engine where oil is to be filled with the oil filling device and such adjustment is done with a novel and unique structure and arrangement that has never been proposed and known.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An oil filling device, comprising:

an oil filling funnel, which has a lower end to which an insertion connector is connected, the insertion connector having a lower end to which an angled fitting is mounted in such a way that a funnel hole of the oil filling funnel, a connector hole of the insertion connector, and an angled fitting hole of the angled fitting are in communication with each other;

an extendable tube assembly, which comprises a first tubular member having a first end to which an end of the angled fitting is fit so that the angled fitting hole is in communication with a first bore defined through the first tubular member, the first tubular member having an opposite end to which an end connector is mounted, the end connector forming therein a tapered bore that comprises at least a tapering section that receives and retains therein a conical wedge block that has a C-shaped cross-section, a second tubular member being telescopically received through the conical wedge block and into the first tubular member, a fastening element having an internally threaded hole that is set in engagement with an external thread of the end connector, whereby with the second tubular member being telescopically moved with respect to the first tubular member to assume a desired length, the fastening element is rotated to drive the conical wedge block further into the tapered bore to get compressed and simultaneously fix the first tubular member and the second tubular member to each other, the first bore being in communication with a second bore defined through the second tubular member;

a direction adjustment assembly, comprising a rotary adjustment knob, a fastening knob, and a T-shaped fitting, the T-shaped fitting having a top portion forming a lateral passage to receive the rotary adjustment knob to extend therethrough in such a way that the rotary adjustment knob is rotatable with respect to the T-shaped fitting, the T-shaped fitting comprising a vertical passage formed therein to extend downward from and in communication with the lateral passage, the rotary adjustment knob having a first end forming an internally threaded hole that engages an external thread formed at a free end of the second tubular member and an opposite second end forming a hole in communication with the internally threaded hole, the rotary adjustment knob having a circumferential wall in which a plurality of through holes is formed to correspond to the vertical passage to communicate with the vertical passage, the rotary adjustment knob comprising an external thread formed at the second end thereof to engage an internal thread formed in the fastening knob, whereby when the rotary adjustment knob is rotated and set at a desired angular position, the fastening knob is rotated to abut against the T-shaped fitting and thus secure the rotary adjustment knob in position; and a coupling assembly, which comprises a locking cap, the locking cap forming an insertion bore to receive and retain the T-shaped fitting in such a way that the vertical passage is in communication with the insertion bore, the locking cap having a lower end forming an external thread adapted to engage an internal thread of an oil filling opening of an engine in such a way that the insertion bore is in communication with the engine, the external thread of the lower end of the locking cap being selectively provided with a gasket set around an outer circumference thereof.

2. The oil filling device as claimed in claim 1, wherein the locking cap has a side portion forming an inverted T-shaped vent hole in such a way that the inverted T-shaped vent hole has a first opening that is in communication with the engine, a second opening that is formed in a side surface of the locking cap to communicate with the outside atmosphere, and a third opening that is formed in the top of the locking cap to communicate with the outside atmosphere.

* * * * *